United States Patent [19]

Wexler

[11] Patent Number: 4,938,688

[45] Date of Patent: Jul. 3, 1990

[54] CAKE COVER AND CANDLE HOLDER

[76] Inventor: Ethel Wexler, 23108 L'Ermitage Cir., Boca Raton, Fla. 33433

[21] Appl. No.: 362,090

[22] Filed: Jun. 6, 1989

Related U.S. Application Data

[63] Continuation-in-part of Ser. No. 233,537, Aug. 10, 1988, Pat. No. 4,884,966.

[51] Int. Cl.[5] ..... F23D 3/16

[52] U.S. Cl. ..... 431/295; 312/284; D7/392.1; D7/540

[58] Field of Search ..... 431/253, 295; 428/7; D7/83; 206/45.32; 220/377, 306; 362/209, 806; 312/284

[56] References Cited

U.S. PATENT DOCUMENTS

| | | | |
|---|---|---|---|
| D. 285,159 | 8/1986 | Wexler | D7/83 |
| D. 298,859 | 12/1988 | Crisci | D7/83 |
| 2,758,458 | 8/1956 | Carlson | D7/83 |
| 2,811,152 | 10/1957 | Wicks | D7/83 |
| 3,736,214 | 5/1973 | Birnie | D7/83 |
| 3,819,455 | 6/1974 | MacKendrick | 431/295 |

FOREIGN PATENT DOCUMENTS

| | | | |
|---|---|---|---|
| 584870 | 11/1958 | Italy | 431/295 |

*Primary Examiner*—Carl D. Price
*Attorney, Agent, or Firm*—Alvin S. Blum

[57] ABSTRACT

A transparent plastic cover for cakes has a horizontal top and vertical sides. The top has indentations for holding candles vertically. The indentations are arranged in the form of two side-by-side rectangles with a central horizontal bar. When all the indentations are filled with candles, the number "88" is indicated. By selective filling of the indentations one can indicate any number between one and ninety-nine. The combined cake cover and candle holder permits decorating the cake with lighted candles representing a numerical celebration of a birthday, anniversary etc. The cake is protected from the candles and from the saliva from blowing out the candles.

16 Claims, 3 Drawing Sheets

CAKE COVER AND CANDLE HOLDER

This application is a continuation in part of copending application Ser. No. 233,537 filed 8/10/88 now U.S. Pat. No. 4,884,966.

BACKGROUND OF THE INVENTION

This invention relates to protective cake covers and more particularly to protective cake covers that also serve as holders for candles that can designate any number by their arrangement.

Traditionally, joyful occasions such as birthdays, anniversaries and the like are celebrated with a cake holding a plurality of lighted candles. The honored party is called upon to blow out the candles. The practice often subjects the celebrants to cake with a saliva topping. Furthermore, the insertion and removal of candles from the decorated cake top is unappetizing and unsanitary. Ordinarily, one lights one candle for each year of the celebration. For large numbers this may require an excessive number of candles.

MacKendrick, U.S. Pat. No. 3,819,455 and Wexler, U.S. Pat. Des. 285,159 teach protective cake covers that also function as candle holders for cakes. It is not practical to provide the cake covers of the prior art with enough candle recetacles to represent a large number such as a 50 year anniversary or birthday.

SUMMARY OF THE INVENTION

It is, accordingly, an object of the invention to provide a cover for covering a cake to protect it from the saliva of blowing out the candles. It is a further object to provide such a cover that will also hold the candles without substantially marring or obscuring the decorative surface of the cake.

The cover of the instant invention is comprised of a thin-walled, transparent plastic having indentations in its rectangular top for holding candles. Connected to the top are downwardly directed vertical walls. The vertical walls may terminate in a substantially horizontal flange. The candle-holding depressions in the top are arranged in the form of two rectangles with a horizontal bar across each rectangle. By proper placement of the candles in these rectangles, one may form any digit between zero and nine. Consequently, one may arrange candles in the cover to indicate any number from one to ninety-nine with a maximum of twenty-six candles. The underside of the indentations are arranged to engage short tubes or tripods to provide supports or stand-offs to raise the cover and its many indentations above the icing on the cake. The indentations selected for engaging these supports are those whose locations do not affect the appearance of the icing.

These and other objects, features and advantages of the invention will become more fully apparent when the following detailed description of preferred embodiments of the invention is read in conjunction with the accompanying drawings.

DETAILED DESCRIPTION OF PREFERRED EMBODIMENTS

Figure 1:
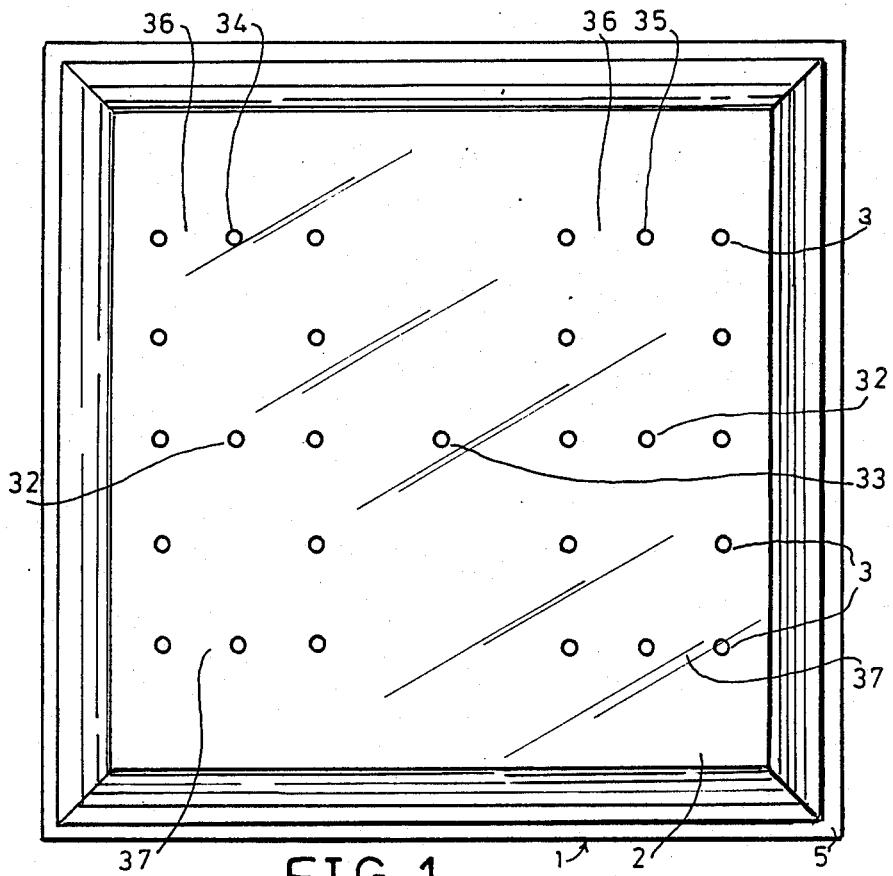
FIG. 1 is a top view of a rectangular cover of the invention.
Figure 2:
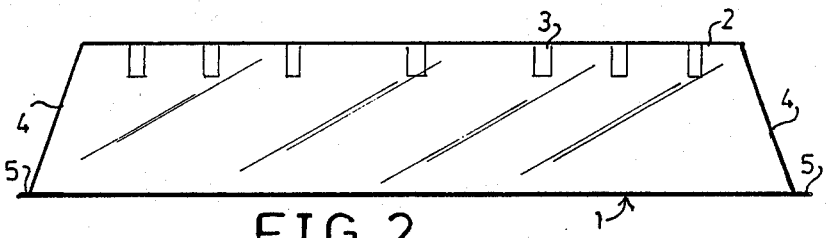
FIG. 2 is a front elevation view of the cover of FIG. 1.

Referring now first to FIGS. 1 and 2, illustrating a cover 1 having a flat rectangular top surface 2 having a plurality of indentations 3 shaped to receive candles. The cover is preferably vacuum formed from thin wall plastic suitable for food use. The thickness has been exaggerated for illustrative purposes. In vacuum thermoforming of sheet plastic, the shape of the cover 1, with sloping vertical sides 4 terminating in flange 5 extending completely around the cover is an optimum design because the flange 5 is generally in the plane of the original sheet. This cover has inherent rigidity derived from its shape even in thin plastic.

It is suitable for covering a cake of dimensions less than the dimensions of top 2. Dimensions of the top 2 of fifteen inches square and a plastic thickness of two one-hundredths of an inch have been found suitable. The candle holding indentations 3 have yielding, tapering sides 9 to better grasp the candle and to facilitate the nesting together of the holes of multiple covers for compact storage.

Figure 3:
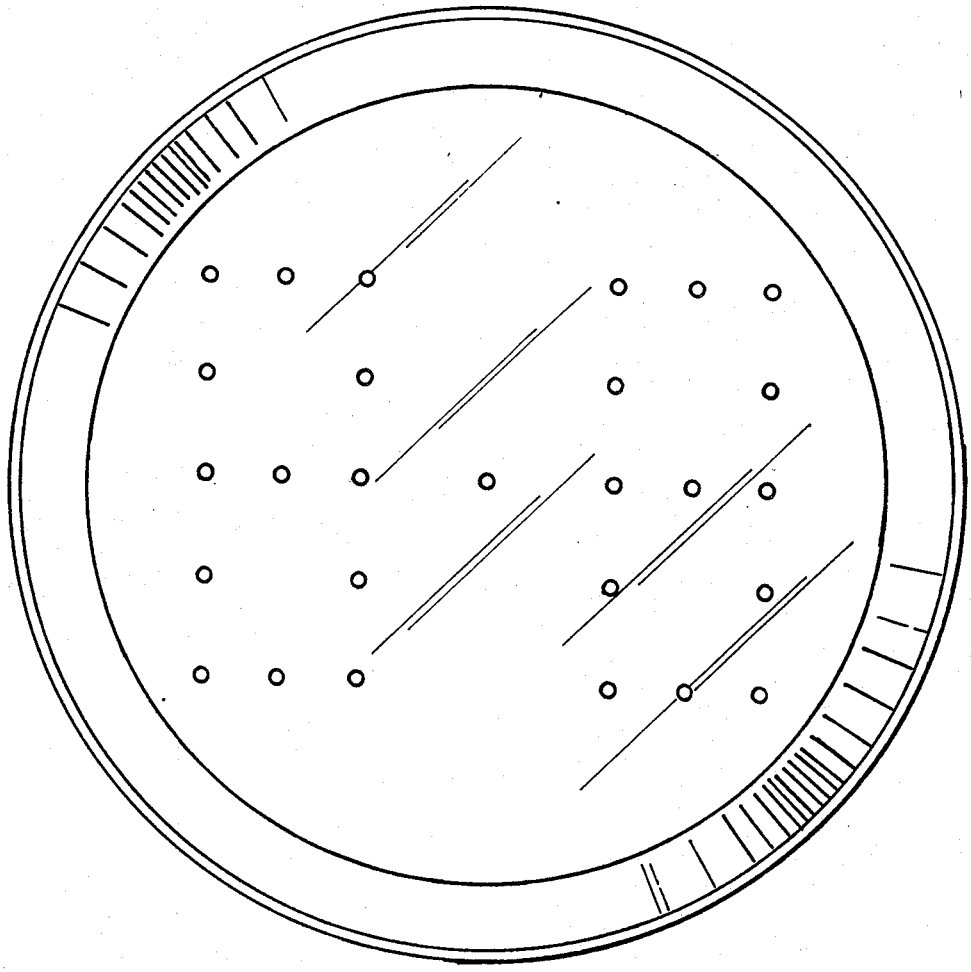
FIG. 3 is a top view of a circular cover of the invention.
Figure 4:
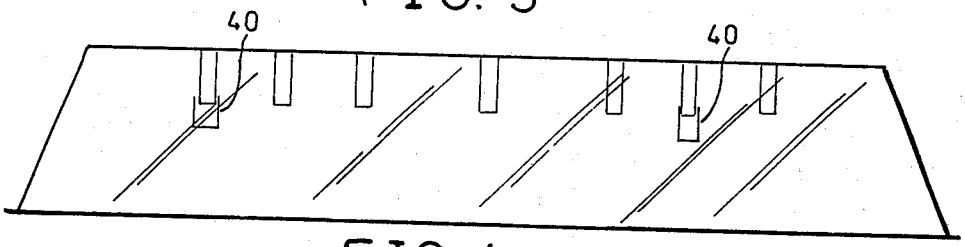
FIG. 4 is a front elevation view of the cover of FIG. 3.

Referring now to FIGS. 3 and 4, a circular shape cover is shown for covering round cakes. It is similarly provided with indentations in top 2 for holding candles in substantially vertical positions. It also has sloping vertical walls 4 terminating in a bottom flange 5.

Figure 5:
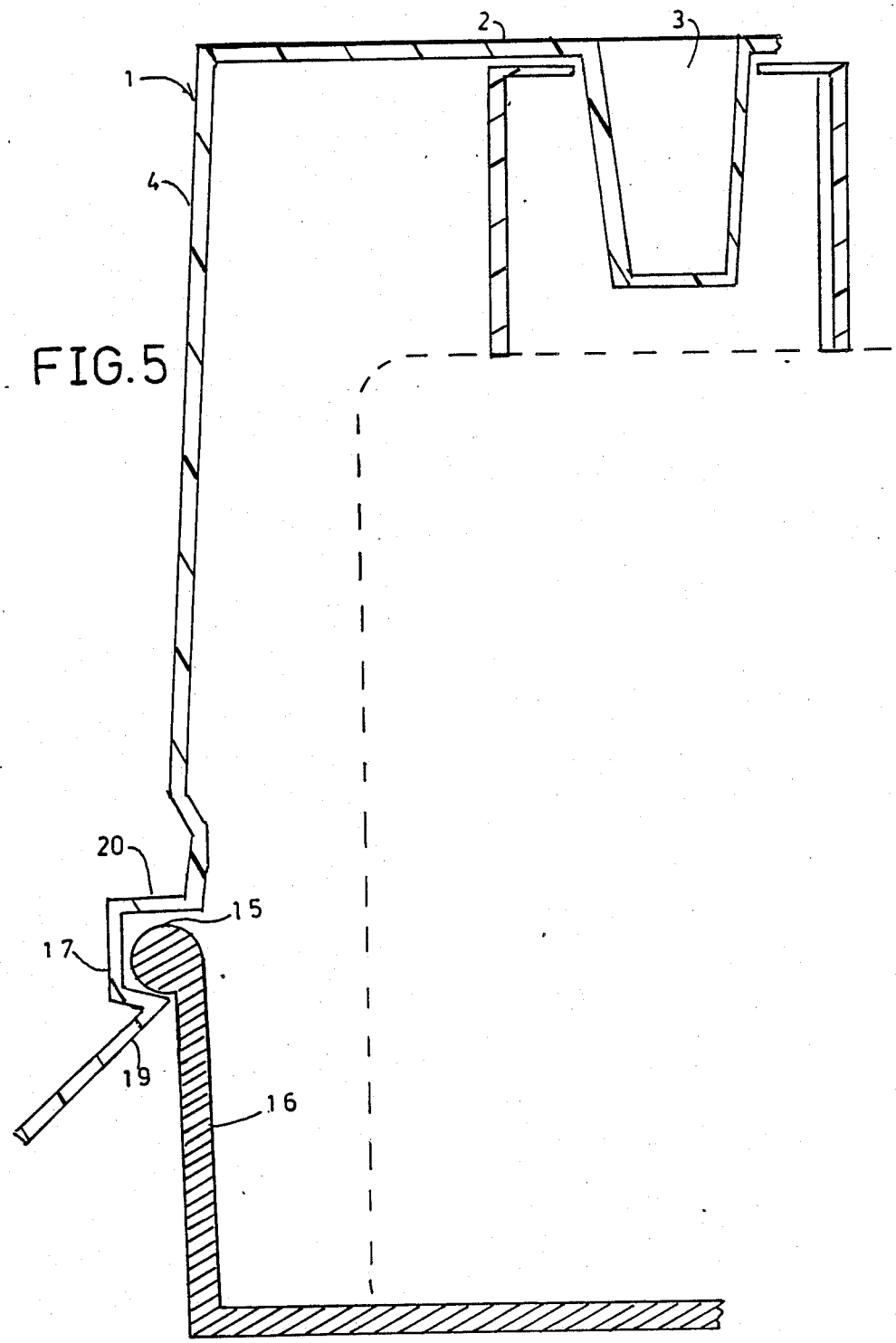
FIG. 5 is a vertical sectional view of a portion of the cover illustrating several means of supporting the cover.

The side walls 4 of the embodiment of the cover 1 illustrated in FIG. 5 terminate at their lowermost edge in a modified flange 17 for latching onto the rim 15 of a cake pan 16. A sloping latching portion 19 slides outwardly when the cover 1 is formed down onto the pan 16 until stop 20 halts downward movement and the sloping portion 19 has passed rim 15, whereupon the flange 17 snaps inwardly, locking onto the rim.

A cake 12 shown in phantom is covered by cover 1. The thickness of the cover is exaggerated for illustrative purposes. It is made of very thin plastic, with a thickness range of 0.010 to 0.050 inches found to represent a satisfactory compromise between strength and economy. The plane of the section passes through one indentation 21 and tripod 22. A plurality of tripods are pushed onto indentations 3 that are selected for locations that will hold the cover 1 in place without marring critical elements of the decorative icing of cake 12. By providing three legs to rest on the cake, a stable support that applies reduced pressure to the cake is provided. Alternatively, as shown in FIG. 4, tubular elements 40 may be slipped over the lower end of selected indentations 3 so that the cover may rest upon the top of the cake only at these points.

Referring again to FIGS. 1 and 3, the indentations 3 in top surface 2 are arranged in a specific configuration so that the user can insert candles to indicate any number from one to ninety-nine with the use of only twenty-six candles. Furthermore, the number can be read without counting the candles. The indentations 3 are arranged in a left rectangle 34 and a right rectangle 35. Each rectangle also has at least one indentation 32 that is located along a horizontal line parallel to and midway between, the top 36 and the bottom 37 of each rectangle.

By filling certain indentations 3 in the rectangle with candles, one can provide any illuminated digit from zero to nine in the same way as with digital displays using electric lights. A center indentation 33 is provided for an extra "good luck" candle and for a central support when required. When all the indentations 3 are filled in both rectangles the number "88" is displayed.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A combined candle holder and cake cover for holding candles and protecting rectangular cakes, comprising:

(a) a substantially rectangular horizontal top portion having four edges;

(b) a plurality of indentation means in said top extending downwardly below said top, each said indentation means having an opening at its upper end for receiving a candle and a lower portion below said top for supporting the lower end of said candle in a substantially vertical position, said indentation means arranged in a pair of side-by-side configurations each of which indicates any digit from zero to nine by selective filling of said indentation means with said candles; and (c) four sloped sides, one edges extending downwardly from each of said four sides of said top portion, said sides terminating at lower margins.

2. The cover according to claim 1 composed of transparent material.

3. The cover according to claim 1, including flange means extending horizontally from the lower margins of said sides.

4. The cover according to claim 3, in which said flange means further includes engaging means for engaging a rim of a support that supports said cake.

5. The cover of claim 1, including a plurality of tubular elements for attaching to said lower portion of selected indentation means, said tubular elements having two ends, said ends structured for removably attaching to said lower portion of said indentation means at a first end and for resting upon said cake at a second end for raising said cover above said cake to prevent unselected indentation means for marring said cake, wherein said selected indentation means are selected for their locations at sites that will support said cover and not mar important decorative elements of said cake.

6. The cover of claim 1, including a plurality of support elements for attaching to said lower portion of selected indentation means, said support elements having a first end with indentation-engaging means for attaching to said indentation means and a second end with a plurality of legs for engaging the upper surface of said cake.

7. The cover of claim 6, in which said support elements each have three legs.

8. The cover according to claim 1, in which each said configuration is a rectangle with a central portion having at least one indentation means, said configuration indicating the digit eight when all said indentation means are occupied.

9. A combined candle holder and cake cover for holding candles and protecting round cakes, comprising:

(a) a substantially circular horizontal top portion;

(b) a plurality of indentation means in said top extending downwardly below said top, each said indentation means having an opening at its upper end for receiving a candle and a lower portion below said top for supporting the lower end of said candle in a substantially vertical position, said indentation means arranged in a pair of side-by-side configurations each of which indicates any digit from zero to nine by selective filling of said indentation means with said candles; and (c) a continuous sloped side wall extending downwardly from said top portions.

10. The cover according to claim 9 composed of transparent material.

11. The cover according to claim 9, including flange means extending horizontally from a lowermost portion of said side.

12. The cover according to claim 11, in which said flange means further includes engaging means for engaging a rim of a support that supports said cake.

13. The cover of claim 9, including a plurality of tubular elements for attaching to said lower portions of selected indentation means, said tubular elements having two ends, said ends structured for removably attaching to said lower portion of said indentation means at a first end and for resting upon said cake at a second end for rising said cover above said cake to prevent unselected indentation means from marring said cake, wherein said selected indentation means are selected for their locations at sites that will support said cover and not mar important decorative elements of said cake.

14. The cover of claim 9, including a plurality of support elements for attaching to said lower portion of selected indentation means, said support elements having a first end with indentation-engaging means for attaching to said indentation means and a second end with a plurality of legs for engaging the upper surface of said cake.

15. The cover of claim 14, in which said support elements each have three legs.

16. The cover according to claim 9, in which each said configuration is a rectangle with a central portion having at least one indentation means, said configuration indicating the digit eight when all said indentation means are occupied.

* * * * *